US006684757B2

(12) United States Patent
Petersen

(10) Patent No.: US 6,684,757 B2
(45) Date of Patent: Feb. 3, 2004

(54) GAS GRILL PROPANE MONITOR

(76) Inventor: Bradley Frank Petersen, 1263 E. Woodridge Cir., Salt Lake City, UT (US) 84121

( * ) Notice: Subject to any disclaimer, the term of this patent is extended or adjusted under 35 U.S.C. 154(b) by 0 days.

(21) Appl. No.: 10/417,931

(22) Filed: Apr. 17, 2003

(65) Prior Publication Data

US 2003/0196555 A1 Oct. 23, 2003

Related U.S. Application Data

(60) Provisional application No. 60/373,790, filed on Apr. 19, 2002, and provisional application No. 60/441,336, filed on Jan. 21, 2003.

(51) Int. Cl.[7] ..... A47J 27/00; F24C 3/00

(52) U.S. Cl. ..... 99/332; 99/337; 99/344; 99/400; 99/446; 126/25 R; 126/41 R

(58) Field of Search ..... 99/325–332, 337, 99/338, 341, 344, 339, 340, 400, 401, 390, 444–450, 481, 482; 126/25 R, 42, 41 R, 25 B, 39 E, 39 BA, 9 R; 137/624.11, 624.12, 624.21; 251/11, 74, 129.1; 340/632, 606, 346; 219/707; 73/40.7; 239/585.5; 141/198

(56) References Cited

U.S. PATENT DOCUMENTS

| | | | | | |
|---|---|---|---|---|---|
| 4,295,028 | A | * | 10/1981 | Tanabe | 219/707 |
| 4,557,139 | A | * | 12/1985 | Cantwell et al. | 73/40.7 |
| 4,686,958 | A | * | 8/1987 | Skelton et al. | 126/369.2 |
| 4,760,836 | A | * | 8/1988 | Witzel | 126/42 |
| 4,781,170 | A | * | 11/1988 | Perl | 126/39 E |
| 4,916,437 | A | * | 4/1990 | Gazzaz | 340/632 |
| 4,937,558 | A | * | 6/1990 | Robinet et al. | 340/606 |
| 5,003,449 | A | * | 3/1991 | Stephenson et al. | 362/346 |
| 5,213,075 | A | * | 5/1993 | Stephen et al. | 126/25 B |
| 5,458,294 | A | * | 10/1995 | Zachary et al. | 239/585.5 |
| 5,544,685 | A | * | 8/1996 | Stieferman | 141/198 |
| 5,628,242 | A | * | 5/1997 | Higley | 99/332 |

* cited by examiner

*Primary Examiner*—Timothy F. Simone

(57) ABSTRACT

Generally speaking, a latching valve is easily installed in the path of gas flow on a gas grill. Once a grill is turned on, an automatically activated on/off switch activates a electric timing device, which begins monitoring time. The timing device is adjustable by the user to set the amount of time it will accrue prior to sending power to a latching valve, terminating the gas flow. So, if a gas grill is inadvertently left on, the latching valve will receive power and be closed, saving fuel and preventing a possible hazard. At this point a reset button on the timing device must be pressed to reopen the latching valve. But, if a gas grill is used and shut off prior to that time set by the timing device no action will result from the Gas Grill Propane Monitor.

12 Claims, 5 Drawing Sheets

GAS GRILL PROPANE MONITOR

This application claims priority from the U.S. Provisional Patent Applications Serial Nos. 60/373,790 filed Apr. 19, 2002 and 60/441,336 filed Jan. 21, 2003.

FIELD OF THE INVENTION

The present invention relates to an automatic gas shut off valve and, more particularly, to a propane gas shut off valve for a barbeque grill not allowing the propane to flow if a the grill is unintentionally left on for an extended period of time.

BACKGROUND OF THE INVENTION

When using a gas grill to barbeque food it is common that the grill is turned on and allowed to heat up prior to placing food on the grill, the food is then placed on the grill, cooked, and removed from the grill. Many times the user of the grill will then decide to leave the burners on so the remnants of the food may be burned off, then leaving the grill and returning to the kitchen where the user is more interested in enjoying the grilled food than remembering to return to the grill and shut the burners off. At this point many things can happen, first of all the grill becomes very hot and may become a fire hazard, second the propane in the tank is wasted by being allowed to run until empty, third it is a hassle the next time the user decides to use the grill, they must remove the tank and make a visit to the propane vendor. The current system leaves room for human error. By using this Gas Grill Propane Monitor valve it would set a time limit on the time a grill would be allowed to run and eliminate the problems mentioned, making grilling a safer activity.

There are other inherent prior art which monitor the last known activity by means of a motion detector of lid sensor installed in the gas line after the pressure reducer valve such as listed in U.S. Pat. No. 5,628,242.

Another prior art approach is a gas valve regulated by a mechanical spring turned to a anticipated amount of time.

These prior art approaches have inherent short comings; By installing the valve after the pressure reducer in the gas line it may require cutting the gas line which may lead to propane leaks and even if there was a threaded connection between the gas hose and the grill many grills today are surrounded by metal enclosures which would make it difficult to access if a device was installed in this area. Since it would be necessary to access each time a grill was used.

Other current inventions call for an egg timer approach which is a manual way of going about shutting off the fuel.

Prior inventions have addressed many of the problems associated with grilling and using gas to cook, but none have been so simple as the Gas Grill Propane Monitor to install on any existing grill; or perform the function of protecting against hazards without the user having to change their habits of using a gas grill. The Gas Grill Propane Monitor is an install it and forget about it device that truly protects against human error.

It is therefore an object of the invention to prevent a possible fire hazard and waste of fuel when a gas grill is inadvertently left on after use by automatically shutting off the fuel supply.

It is another object of the invention to automatically detect when a barbeque grill is activated by means of employing the preferred element on/off switch, thermostat sensor.

It is another object of the invention to begin monitoring time once a barbeque grill is turned on.

It is another object of the invention to adjust the timing device's limit by means of a potentiometer to set a destination point or time-on make point.

It is another object of the invention to shut the fuel supply off if the timing device is allowed to accrue minutes equal to the preset amount of time set by the potentiometer.

It is another object of the invention to terminate propane supply if the power source of the invention drops below the necessary voltage to power it.

SUMMARY OF THE INVENTION

In accordance with the present invention, there is provided, a prior art latching valve installed in between a propane tank and a barbeque grill pressure reducer, once a grill is turned on, a automatically activated on/off switch or more particularly using a preferred element thermostat sensor switch, activates a timing device which begins monitoring the time since the grill was turned on. The timing device, employs a user adjustable potentiometer to set the amount of time the timer will accrue prior to sending power to a latching valve, resulting in terminating gas flow. So if a gas grill is used and is always shut off prior to that time set by the potentiometer no action will result, but if the gas grill is inadvertently left on for a period of time which equals that set by the potentiometer the latching valve would receive power from the timing device and be closed. At this point a reset button on the timing device must be pressed sending a reverse polarity pulse to the latching valve to reopen it. This device is a safety feature that could be ignored once installed, but save the fuel in the tank and avoid possible fire hazards if the grill is forgotten.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the FIGURES.

DESCRIPTION OF THE PREFERRED EMBODIMENT

Figure 1:
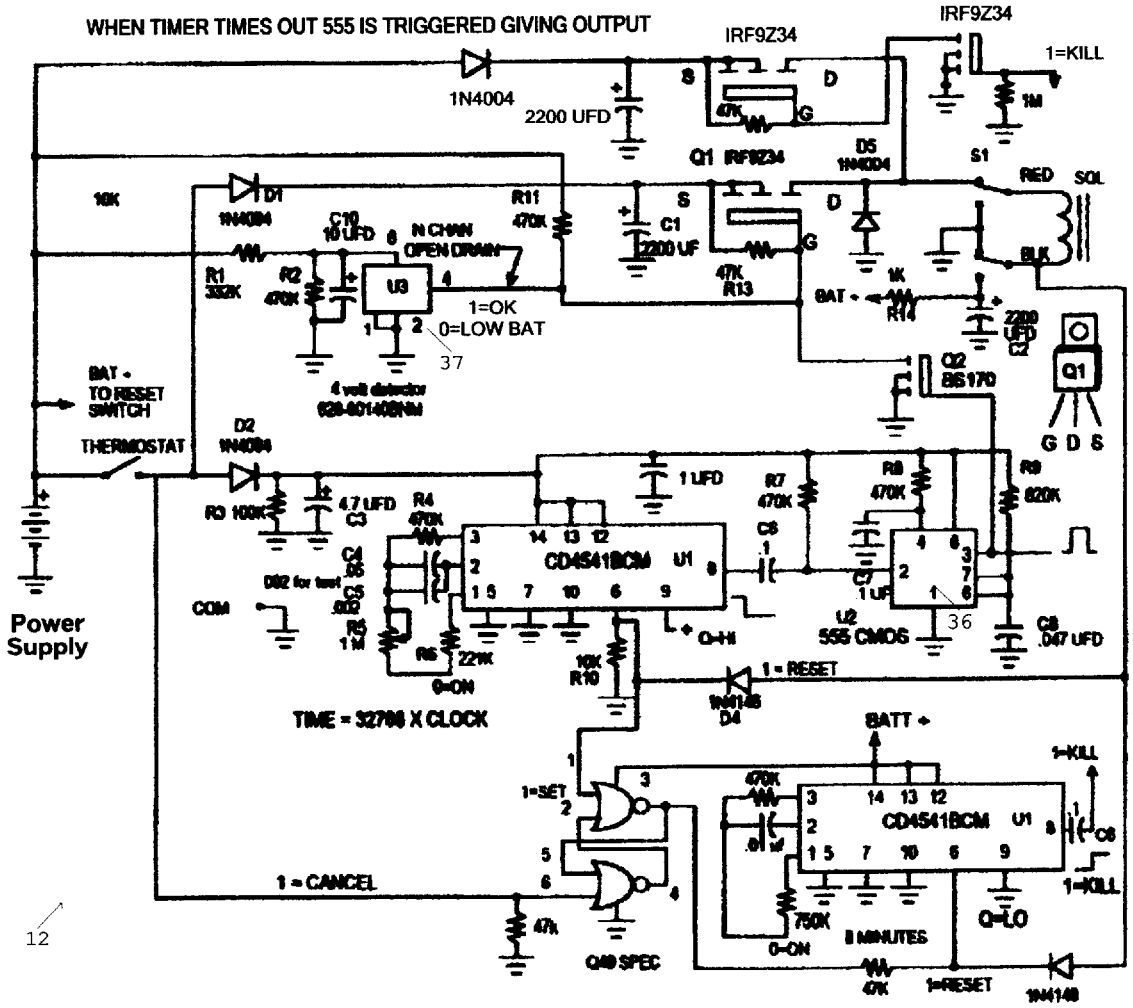
FIG. 1 is a perspective view of a schematic drawing showing the electronic timing device circuit board which controls the functions of the propane monitor.

FIG. 1 is a perspective view of a timing device schematic 12 showing the electronic timing device 11 circuit board, which controls the functions of the Gas Grill Propane Monitor 10. This schematic is a detailed wire diagram indicating components used such as the capacitors, latching circuit 36, a potentiometer 14 pot, double pole double throw switch 38 and other elements used to derive a timing device 11 capable of performing a series of functions. The role of the timing device 11 is to monitor time, to employ an adjustable time selector switch 39 or potentiometer 14 for setting a destination point for the timing device 11 to stop monitoring time and deploy a power source 27. To contain a low voltage detector 37 shutoff feature, so if the battery 35 voltage drops, for example to around 7.5 volts; the timing device 11 sends a pulse to close the latching valve 15 regardless of the time remaining on the timing device 11. In order to reopen the latching valve 15 by means of pressing a reset switch 13, so the barbeque grill 28 will function, a new battery 35 must be installed. The timing device 11 will not allow the latching valve 15 to reopen until a new battery 35 is installed. This feature is to prevent a situation were the battery 35 life drops below the necessary voltage to power the Gas Grill Propane Monitor 10 and the valve is expected to function, but cannot, due to a low voltage power source 27. This timing device 11 also has a safety feature, which prevents, in the situation that the reset switch 13 is pressed, opening the latching valve 15, allowing propane to flow, but the barbeque grill 28 is not activated, to send a power pulse after approximately seven minutes to the latching valve 15 to re-close it. By means of a latching circuit 36 that would be initialized when the reset switch 13 is pressed. If the on/off switch 17 is activated due to the barbeque grill 28 being activated, and the timing device 11 begins monitoring the latch circuit would be disabled. Otherwise, if these functions are not detected, the latch circuit will send a power pulse to close the latching valve 15. The described timing device 11 is exemplary of possible timers, which could be used for the operation of this invention.

Figure 2:
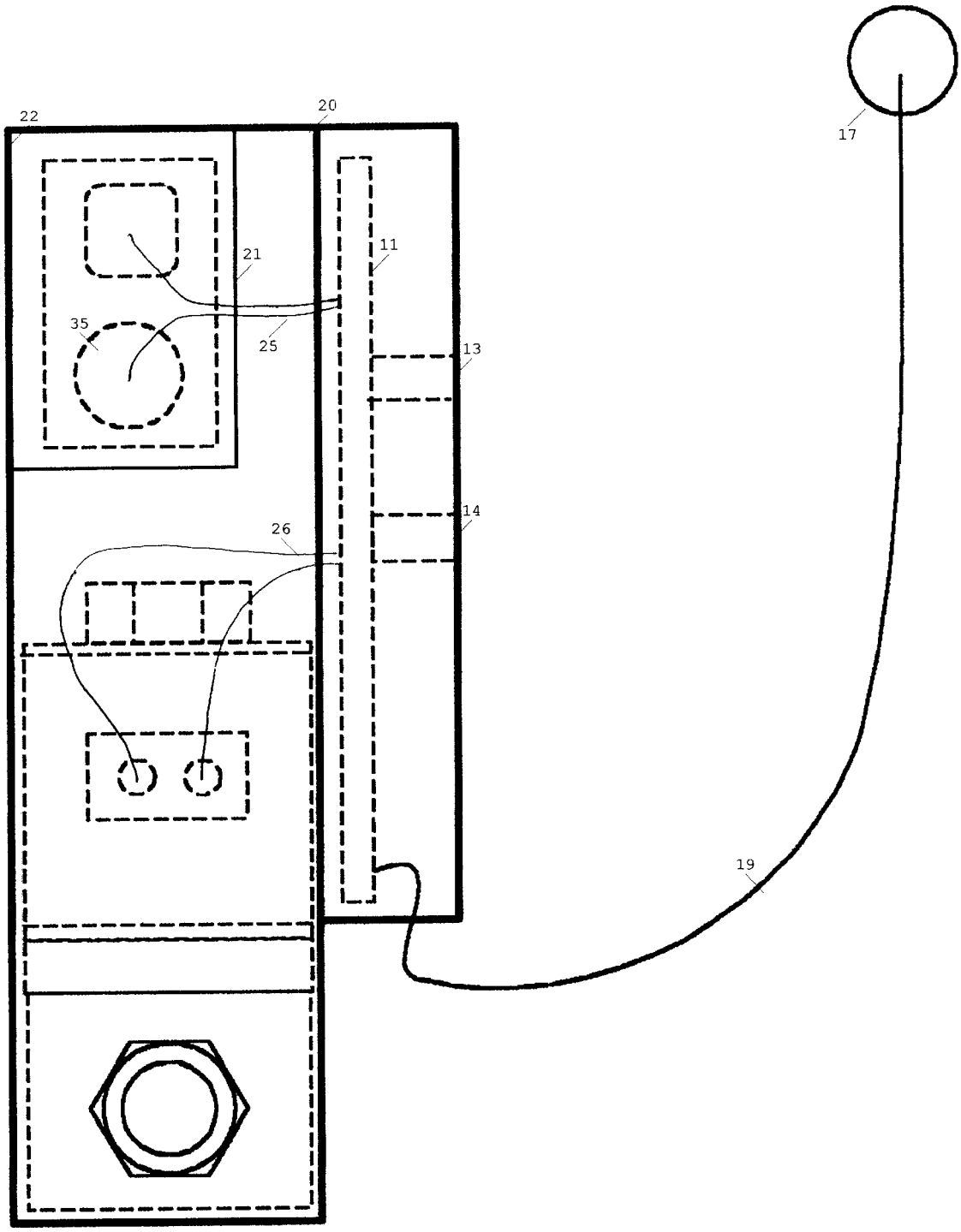
FIG. 2 is a side view of a plastic case enclosing the latching valve, the timing device and power supply indicated by the interior dashed lines also the external timing device activator, on/off switch.

FIG. 2 is a side view of the Gas Grill Propane Monitor 10 as a plastic case 20 showing a power source compartment 21 containing a battery 35 which is an example of one of the possible ways to power the invention and power source compartment cover 22 indicated by a solid lines, enclosing the latching valve 15, the timing device 11 circuit board and power source 27 all indicated by dashed lines, also an external on/off switch 17 which may be any type switch capable of detecting the manual activation and manual shut off of a barbeque grill 28 at which point this switch will activate the timing device 11. Listed here are some examples of possible switch configurations, which would be means for activating the timing device 11. A thermostat switch which detects a grill heating up and detects a grill cooling down resulting in opening and closing a circuit to activate and deactivate the timing device 11. A flow sensor switch which detects the flow of gas once the grill is activated, which would result in activating the timing device 11, A dial switch placed under the prior art gas control knob which would be activated once the knob is turned on to activate the burners resulting in activating the timing device 11. These on/off switch 17 configurations describe the general idea of what is necessary for the described invention to be activated although since there are a large variety of switch configurations, which could be used, the listed on/off switches are exemplary only.

Figure 3:
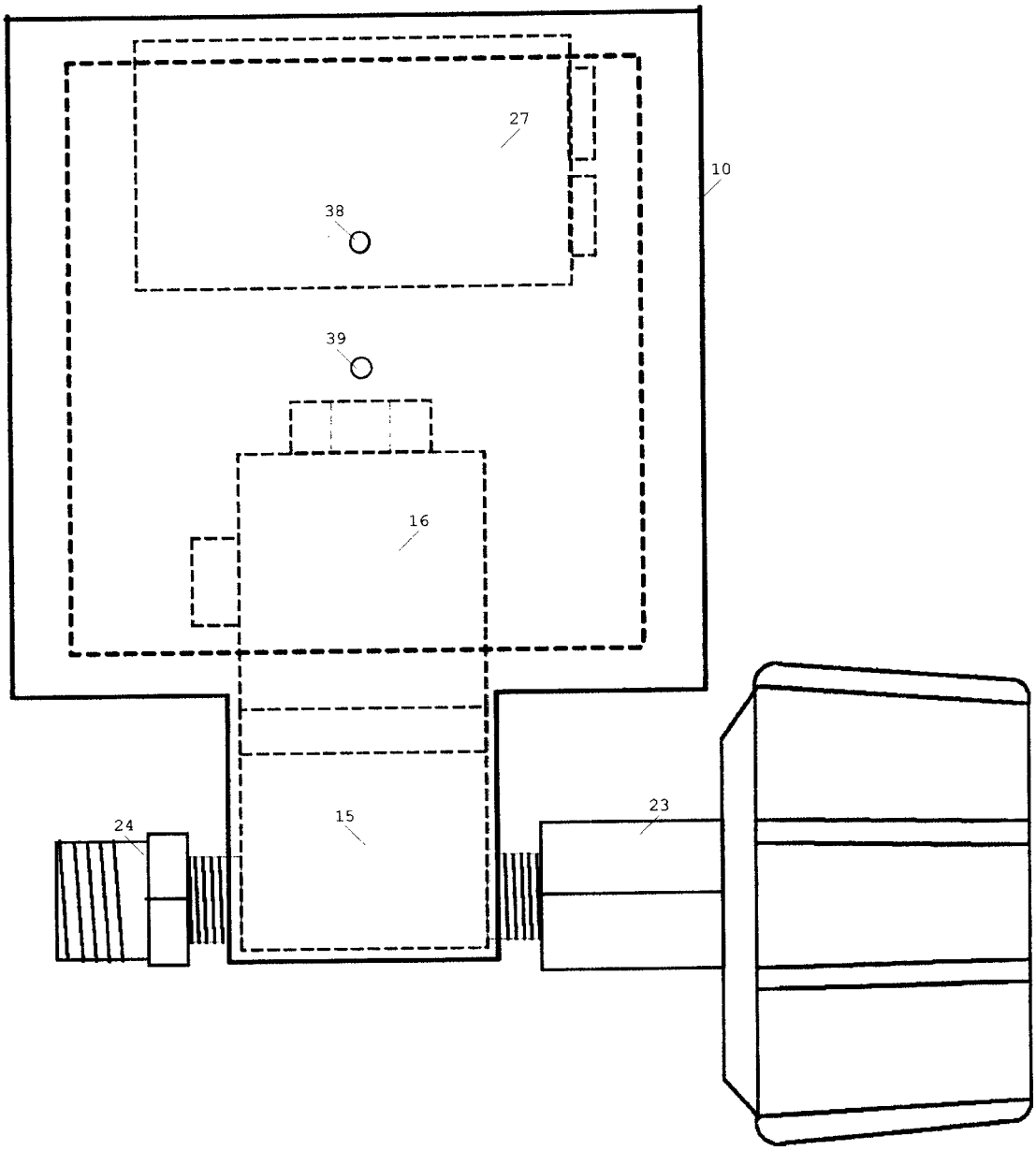
FIG. 3 is a perspective front view of a gas grill propane monitor showing in dashed line detail, the timing device, latching valve and power supply enclosed in a case detailed by the outer solid line using prior art mounting connections to connect to both the pressure reducing valve and the ACME tread connection of a propane barbeque grill.

FIG. 3 is a perspective front view of the Gas Grill Propane Monitor 10. Indicated by dashed lines the timing device 11, power source 27 and latching valve 15 enclosed in a case connected to a male adapter fitting (outlet) 24 which is to be inserted into a pressure reducer valve 30 and a female reducing fitting (Inlet) 23 connected to the ACME thread connector 32 or at times referred to as a QCC1 connector which fastens to a propane gas tank 29. The Gas Grill Propane Monitor 10 employs a latching valve 15 for the purpose of terminating the gas flow. This latching valve 15 comprising a latching valve 15 body and a solenoid 16 which is wired to the timing device 11 via the latching valve lead 26 is a valve that can be operated by AC or DC power and even more crucial to this element is that it is opened or closed by a short 5 ms pulse of power and once positioned remain without the need of power. This allows the invention to operate for many months or possibly a year using only battery 35 power due to the only power demand from the Gas Grill Propane Monitor 10 to function the timing device 11 which charges the capacitors which are the source of power to open and close the latching valve 15 when necessary.

Figure 4:
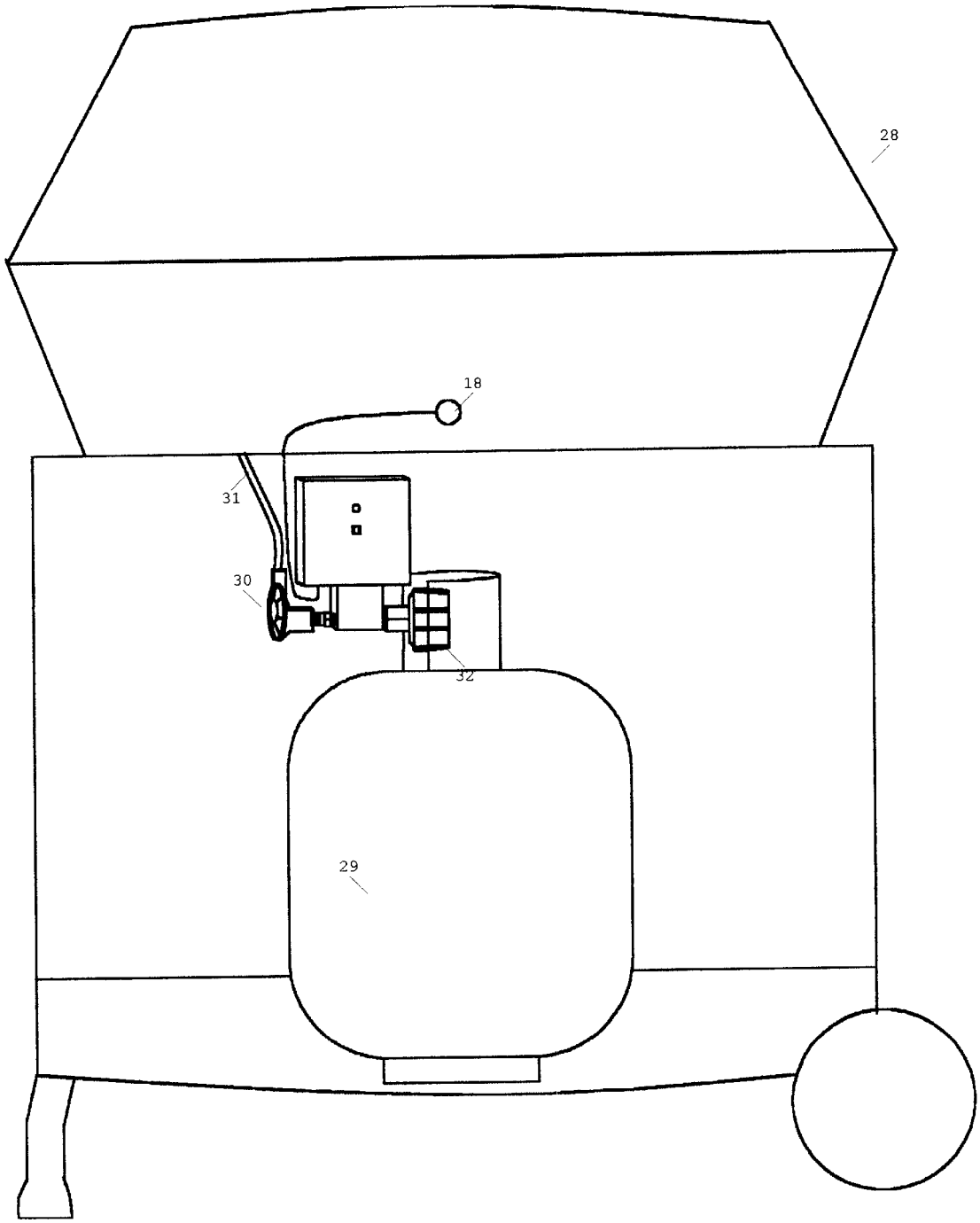
FIG. 4 is an installed view of a Gas Grill Propane Monitor installed in position on a prior art barbeque grill also displaying the external on/off switch which in this example is the preferred alternate thermostat switch mounted to the grill body.

FIG. 4 is a installed view of a Gas Grill Propane Monitor 10 installed in the path of gas flow between the propane gas tank 29 and the pressure reducer valve 30 which is only one of the possible points of connection along the gas line 31. This drawing also depicts a preferred element on/off switch 17 being a thermostat switch, which mounts on the exterior body of a barbeque grill 28 by means of glue, or screws and being connected to the timing device 11 via the on/off switch lead 19. Once the grill heats to a temperature of for example 160 degrees Fahrenheit, the switch circuit closes and turns on the timing device 11 if the grill cools and the thermostat temperature drops below for example 140 the timing device 11 will shut off.

Figure 5:
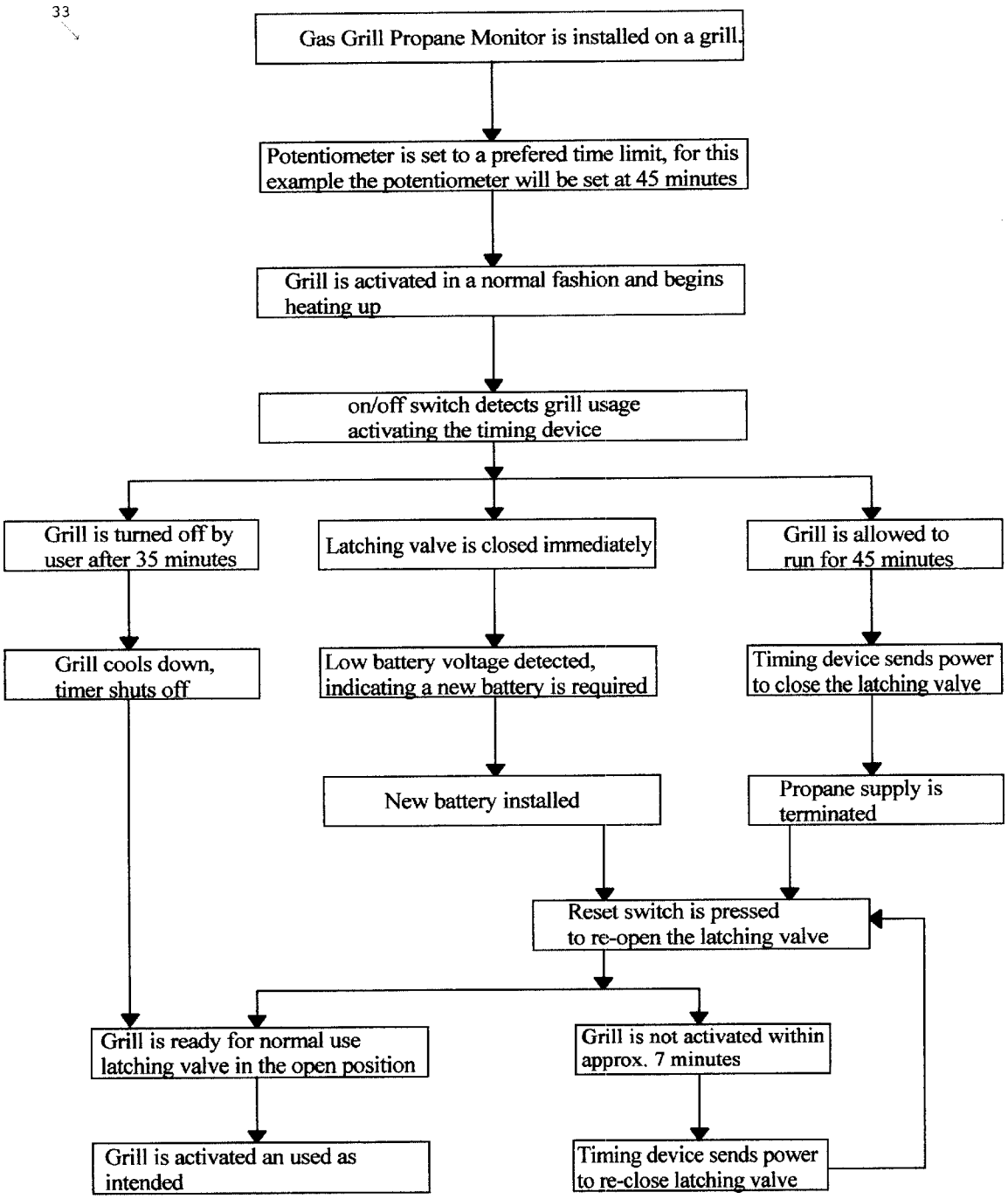
FIG. 5 is a flow chart view of an example sequence of how the Gas Grill Propane Monitor will function once installed on a gas grill.

FIG. 5 is a flow chart 33 view of an example sequence of how the Gas Grill Propane Monitor 10 functions once installed on a gas grill. This chart is described using preferred embodiments such as 9v battery 35 power and a thermostat sensor switch.

Generally speaking, when a barbeque grill 28 is manually turned on, a on/off switch 17 will be simultaneously activated, this switch activates a timing device 11 powered by battery 35 or wall outlet or other means of supplying power to the timing device 11 via the power source lead 25, which will begin monitoring the amount of time that the barbeque grill 28 is being used. This timing device 11 employs a user adjustable switch or potentiometer 14 for setting a time destination point. For example this potentiometer 14 may be adjusted between 30 to 90 minutes. Upon arriving at the adjusted destination point the timing device 11 will send power to the latching valve 15, closing it to shut off the fuel supply. For example If the time preset on the timing device 11 potentiometer 14 is 45 minutes and the grill is manually turned off in 32 minutes, which opens the circuit on the alternate on/off switch 18, the timing device 11 would reset and turn off without sending power to close the latching valve 15. If the grill happens to be inadvertently left on and 45 minutes accrues on the timing device 11, the timing device 11 would send a 9-volt pulse to the latching valve 15 terminating the gas flow, the timing device 11 resets and shuts off. This timing device 11 also employs a manual reset button (for example, a double pole double throw switch 38). So, once the gas has been shut off by the timing device 11 this switch may be pressed to send a reverse pole power pulse to reopen the latching valve 15.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A gas grill propane monitor for monitoring time once a barbeque grill is activated and shutting off the gas source if inadvertently left on longer than the preset allowed time limit comprising:

means for monitoring time;

means for resetting a latching valve, directly connected to said means for monitoring time;

means for setting a time duration directly connected to said means for monitoring time;

means for controlling gas flow, directly wired to said means for monitoring time;

means for activating a timing device, externally wired to said means for monitoring time; and means for powering the gas grill propane monitor components, wired to said means for monitoring time.

2. The gas grill propane monitor in accordance with claim 1, wherein said means for monitoring time comprises a timing device.

3. The gas grill propane monitor in accordance with claim 1, wherein said means for resetting a latching valve comprises a reset switch.

4. The gas grill propane monitor in accordance with claim 1, wherein said means for setting a time duration comprises a potentiometer.

5. The gas grill propane monitor in accordance with claim 1, wherein said means for controlling gas flow comprises a latching valve.

6. The gas grill propane monitor in accordance with claim 1, wherein said means for activating a timing device comprises an on/off switch.

7. The gas grill propane monitor in accordance with claim 1, wherein said means for powering the gas grill propane monitor components comprises a power source.

8. A gas grill propane monitor for monitoring time once a barbeque grill is activated and shutting off the gas source if inadvertently left on longer than the preset allowed time limit comprising:

a timing device, for monitoring time;

a reset switch, for resetting a latching valve, directly connected to said timing device;

a potentiometer, for setting a time duration directly connected to said timing device;

a latching valve, for controlling gas flow, directly wired to said timing device;

an on/off switch, for activating a timing device, externally wired to said timing device; and a power source, for powering the gas grill propane monitor components, wired to said timing device.

9. The gas grill propane monitor as recited in claim 8, further comprising:

a latching circuit, for acting as a fail safe if the gas grill propane monitor is activated and the grill is not.

10. The gas grill propane monitor as recited in claim 8, further comprising:

a low voltage detector, for preventing a failure of the timing device.

11. The gas grill propane monitor as recited in claim 9, further comprising:

a low voltage detector, for preventing a failure of the timing device.

12. A gas grill propane monitor for monitoring time once a barbeque grill is activated and shutting off the gas source if inadvertently left on longer than the preset allowed time limit comprising:

a timing device, for monitoring time;

a reset switch, for resetting a latching valve, directly connected to said timing device;

a potentiometer, for setting a time duration directly connected to said timing device;

a latching valve, for controlling gas flow, directly wired to said timing device;

an on/off switch, for activating a timing device, externally wired to said timing device;

a power source, for powering the gas grill propane monitor components, wired to said timing device;

a latching circuit, for acting as a fail safe if the gas grill propane monitor is activated and the grill is not; and a low voltage detector, for preventing a failure of the timing device.

* * * * *